US005895313A

United States Patent [19]

Ikezaki et al.

[11] Patent Number: 5,895,313

[45] Date of Patent: *Apr. 20, 1999

[54] METHOD FOR MANUFACTURE OF INK JET NOZZLE

[75] Inventors: Yoshiyuki Ikezaki, Nagoya; Toshio Inose, Chiryu, both of Japan

[73] Assignee: Brother Kogyo Kabushiki Kaisha, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/623,414

[22] Filed: Mar. 28, 1996

[30] Foreign Application Priority Data

Mar. 29, 1995 [JP] Japan ..... 7-071307

[51] Int. Cl.[6] ..... B24B 1/00

[52] U.S. Cl. ..... 451/38; 451/76; 451/39; 451/40

[58] Field of Search ..... 451/38, 76, 39, 451/40; 29/890.1, 25.35, 611

[56] References Cited

U.S. PATENT DOCUMENTS

| | | | |
|---|---|---|---|
| 2,426,072 | 4/1947 | Wall | 451/39 |
| 3,093,166 | 6/1963 | Straub | 451/39 |
| 3,298,138 | 1/1967 | McCormick | 451/38 |
| 3,313,067 | 4/1967 | Smith | 451/39 |
| 3,396,495 | 8/1968 | Voss | 451/39 |
| 4,508,749 | 4/1985 | Brannon et al. . | |
| 4,545,155 | 10/1985 | Nakata et al. | 451/40 |
| 4,728,392 | 3/1988 | Miura et al. . | |
| 4,801,954 | 1/1989 | Miura et al. . | |
| 4,801,955 | 1/1989 | Miura et al. . | |

FOREIGN PATENT DOCUMENTS

| | | |
|---|---|---|
| 2-42354 | 11/1985 | Japan . |

*Primary Examiner*—Robert A. Rose
*Assistant Examiner*—George Nguyen
*Attorney, Agent, or Firm*—Kane,Dalsimer,Sullivan, Kurucz, Levy, Eisele and Richard, LLP

[57] ABSTRACT

Abrasive blasting of fine particles is used to remove flash, burrs and dust from a nozzles in a nozzle array plate formed by injection molding. The abrasive blasting is applied from the entry side of the nozzles to remove the flash and roughen the interior of the nozzles. A thin solid flash portion can be formed on the exit side of each nozzle to ensure uniform conditions of all the nozzles before the abrasive blasting is applied.

19 Claims, 3 Drawing Sheets

METHOD FOR MANUFACTURE OF INK JET NOZZLE

BACKGROUND OF THE INVENTION

The present invention relates to a method for manufacturing a nozzle for an ink jet head.

Conventionally, in an ink jet head of the "drop-on-demand" type, the ink is discharged in droplet form from a nozzle by reducing the volume of an ink flow path using piezoelectric ceramics. The ink is replenished by increasing the volume of the ink flow path, and is introduced into the ink flow path via an ink introduction opening. Characters or images are formed on a recording sheet by discharging the ink droplet from a group of nozzles according to predetermined printing data.

The properties and quality of the nozzles greatly influence the ink discharge characteristics of the ink jet head, and the manufacturing procedure of the nozzles therefore affects the end printing quality.

Known methods for manufacturing nozzles for an ink jet head, for instance, are known from: U.S. Pat. No. 4,508,749, wherein ultraviolet (UV) rays are projected onto a polyimide body; and Japanese Patent Publication Hei 2-42354 (corresponding to U.S. Pat. Nos. 4,728,392, 4,801,954, and 4,801,955) wherein photosensitive glass is etched. Further known is a method wherein nozzles are formed by injection molding, and deburring of flash and burrs formed around the nozzles is carried out using a laser. As the number of nozzle holes to be formed in a head may be as high as 32 or 64, the UV method is too time consuming and expensive for mass production. The etching procedure requires masking of both surfaces of the photosensitive glass to form a nozzle, and is also time-consuming and expensive. Lastly, laser deburring of injection molded nozzles is too slow when each nozzle is processed individually, and too expensive and the power consumption too high when several lasers are provided for parallel deburring of the nozzles.

Furthermore, conventionally, if the meniscus formed in each nozzle becomes withdrawn, the amount of ink expelled varies, and a stable ink discharge cannot be performed. To keep the ink discharge of the ink jet head uniform, maintaining a repeatable meniscus in each of the nozzles becomes very important.

Conventionally, an ink affinity processing step is separately applied to the inner wall of the nozzle plate, and the peripheral portions of the nozzles on the nozzle entry side. For example, a thin film having an ink affinity is applied to the nozzle entry side. However, since the ink affinity processing step is a separate process from the nozzle plate manufacturing step, the number of steps is high, special machinery is required and the conventional processing for ink affinity is therefore expensive, and less suitable for mass production.

SUMMARY OF THE INVENTION

It is therefore an object of the present invention to provide an improved method for manufacturing a nozzle, appropriate for mass production.

In order to meet the objects of the invention, a method for manufacturing a nozzle for an ink jet printer is developed for a nozzle having an ink chamber attached to an entry side and discharging ink from an exit side, wherein the ink is discharged from the nozzle by the application of energy such as pressure to the ink chamber. The method includes the steps of: forming a plurality of nozzle holes in a nozzle array member according to a predetermined pattern; abrasive blasting at least the nozzle holes formed in the nozzle array member.

In this method, a nozzle array member having a plurality of nozzle holes is made by a variety of procedures in accordance with the predetermined pattern, and thereafter, the fine particles are blasted at least at the nozzle portions. Flash, burrs and dust on the inner surfaces of the nozzles and in the vicinity of the nozzle portions are abrasive blasted, enabling the forming of a high precision nozzle having improved ink discharge characteristics.

In one development of the invention, the abrasive blasting includes a step of removing flash and burrs from the inner surfaces of the nozzle holes formed in the nozzle array member.

Preferably, the abrasive blasting is applied on the entry side of the nozzle array member, and wherein the abrasive blasting includes a step of: surface roughening at least the inner surfaces and the vicinity thereof of the nozzle holes formed in the nozzle array member.

In this manner, ink flow characteristics are improved by surface roughening, preventing the withdrawal of the meniscus, and nozzles capable of forming stable ink jets can be made.

According to one particular embodiment, the abrasive blasting includes a step of: blasting fine abrasive from 1 μm to 100 μm particle diameter to nozzle holes having 10 μm to 150 μm hole diameter formed in the nozzle array member.

In another particular embodiment, the abrasive blasting includes a step of: blasting fine abrasive at the nozzle array member at a speed of less than 100 m/s, and at a pressure of less than 5 bar.

Accordingly, excessive abrading or damage by the fine abrasive particles is prevented with these operating parameters, and distortion or displacement of the nozzle dimensions does not occur.

In this case, in a particularly favorable development of the invention, the abrasive blasting includes a step of: blasting alumina abrasive particles at the nozzle holes formed in the nozzle array member. Consistent particle diameter and easy processing is readily obtained with alumina, giving a high processing efficiency.

In one aspect of the invention, the method includes a step of injection molding a nozzle array member having a plurality of nozzle holes according to a predetermined pattern. Injection molding is suitable for mass production, and the shape of the nozzle is freely designed. For example, a relatively large taper angle in the nozzle can be achieved.

In this case, the nozzle array member is preferably injection molded from polyethersulfone (PES) resin. As PES resin has high strength and a low linear expansion coefficient, it has a high dimensional precision in processing, and can form nozzles having consistent diameters. Particularly, the process capability for injection molding is good. Alternatively, the nozzle array member is injection molded from the group of resins consisting of: liquid crystal polymer, polyacetal, poly(phenylsulfone), polyphthalamide, polyphenylene oxide, polyetherimide, polysulfone, and polycarbonate.

In another aspect of the invention, a method for manufacturing a nozzle for an ink jet printer is developed for a nozzle having an ink chamber attached to an entry side and discharging ink from an exit side, wherein the ink is discharged from the nozzle by the application of energy such as pressure to the ink chamber. The method includes steps of:

forming a plurality of nozzle depressions in a nozzle array member arranged at predetermined pitches and having a predetermined depth which does not pass through the nozzle array member; forming a predetermined thin solid portion at an exit end of each of the nozzle depression; and blasting through each of the thin solid portions; and forming nozzle holes of a predetermined size in the nozzle depressions of the nozzle array member.

In this manner, the shapes of the respective nozzle hole portions and the condition of the flash formed therein is uniform. By carrying out uniform abrasive blasting, nozzle holes having uniform internal conditions can thereby be made, giving nozzles capable of high quality printing and consistent ink jet characteristics.

In yet another aspect of the invention, a nozzle plate for an ink jet printer comprises: an injection molded plate member; and abrasive blasted, injection molded nozzles formed in said injection molded plate member.

DETAILED DESCRIPTION OF THE PREFERRED EMBODIMENTS

Figure 1:
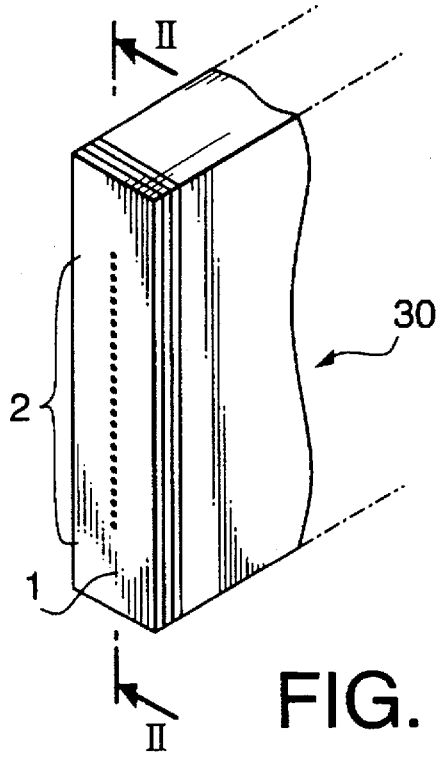
FIG. 1 is a perspective view of an ink jet head to which the embodiments of the present invention are applied.
Figure 2:
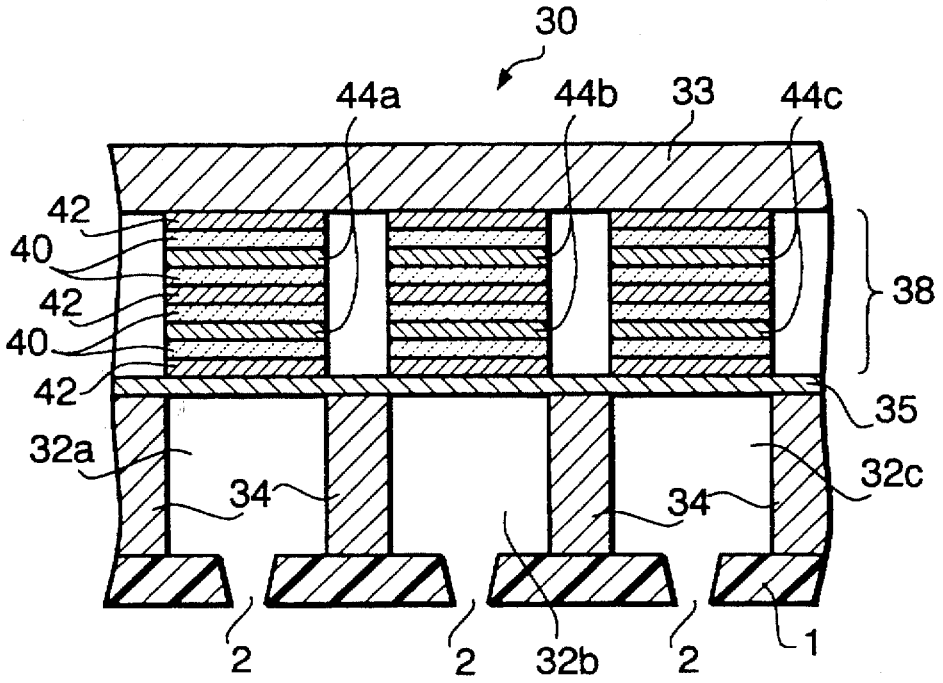
FIG. 2 is a sectional view of an ink jet head, taken along the section line II—II of FIG. 1.

FIG. 1 shows a perspective view of an ink jet head. The ink jet head employs an ink jet array 30, of which a linear array of nozzles 2 formed in a nozzle plate 1 is shown in FIG. 1. FIG. 2 shows a sectional view of the ink jet array 30, taken along the section line II—II of FIG. 1. The ink jet array 30 includes a channel body 34 having ink channels extending in a direction perpendicular to the line direction of the linear array of nozzles 2. In FIG. 2, three ink jets of the linear array of jets 30 are shown, including ink channels 32*a*, 32*b*, and 32*c* formed in the channel body 34. A multi-layer piezoelectric element array 38 is secured to the channel body 34 via an oscillation film 35. The nozzle plate 1, having nozzles 2 formed therein, is secured to the channel body 34 opposing the multi-layer piezoelectric element 38. Finally, base plate 33, formed of metal or ceramic having a high elasticity, is secured to the multi-layer piezoelectric element 38 opposing the ink channels. The ink channels 32*a* through 32*c* each constitute a cavity.

The multi-layer piezoelectric element array 38 is formed by stacking common negative electrode layers 42, piezoelectric ceramic layers 40 (having piezoelectric and electrostrictive properties), and sets of positive electrode layers. Each ink jet has a corresponding set of positive electrode layers, three sets of positive electrode layers 44*a*, 44*b*, and 44*c* being shown in FIG. 2, corresponding respectively to ink channels 32*a*, 32*b*, and 32*c*. The elements of the multi-layer piezoelectric element array 38 are arranged opposite to the ink channels 32*a*, 32*b*, and 32*c*, and the individual elements of the multi-layer piezoelectric element array 38 are narrower than the corresponding ink channels 32*a*, 32*b*, and 32*c*.

In this embodiment, the piezoelectric ceramic layer 40 is made of ceramic material having a strong dielectricity and polarized in the stacking direction, such as lead zirconate titanate (PZT). The negative electrode layers 42 and the sets of positive electrode layers 44*a* through 44*c* are preferably made of conductive metal, for example, chosen from the Ag—Pd system. Furthermore, in this embodiment, four piezoelectric layers 40 for each jet are shown in FIG. 2, and the first and third piezoelectric layers 40 (from the top of FIG. 2) are polarized upwardly in the stacking direction, while the second and fourth piezoelectric layers 40 are polarized downwardly in the stacking direction.

Ink is drawn into the ink channels 32*a*, 32*b*, 32*c*, and discharged to print through the nozzles 2, by selectively applying current among the sets of electrodes, driving the multi-layer piezoelectric element array 38. The driving of the piezoelectric element array 38 selectively generates pressure in the corresponding ink channels 32*a*, 32*b*, and 32*c*.

The section shape of the nozzle plate 1 should preferably be formed such that each nozzle 2 tapers toward the nozzle exit. That is, if the nozzles 2 are not tapered as noted and there is an acute angle corner in the ink flow path, air becomes trapped at the corner, and the ink can be absorbed by the air and prevented from discharge even though pressure is applied.

In order to form a nozzle plate 1 of the desired shape, the forming method may be chosen from any of injection molding, electric casting, etching, punching, cutting. Other methods may be used, but it is preferable that the plurality of nozzles can be formed simultaneously. The material of the nozzle plate 1 may be ceramic, glass, alloys or plastics.

Figure 3:
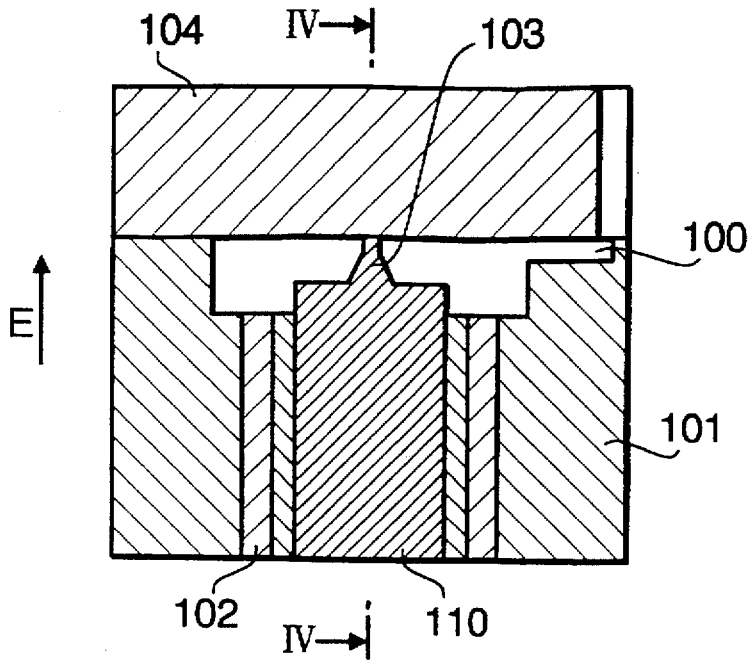
FIG. 3 is a sectional schematic view of a mold used in a method for manufacturing an ink jet nozzle array plate.
Figure 4:
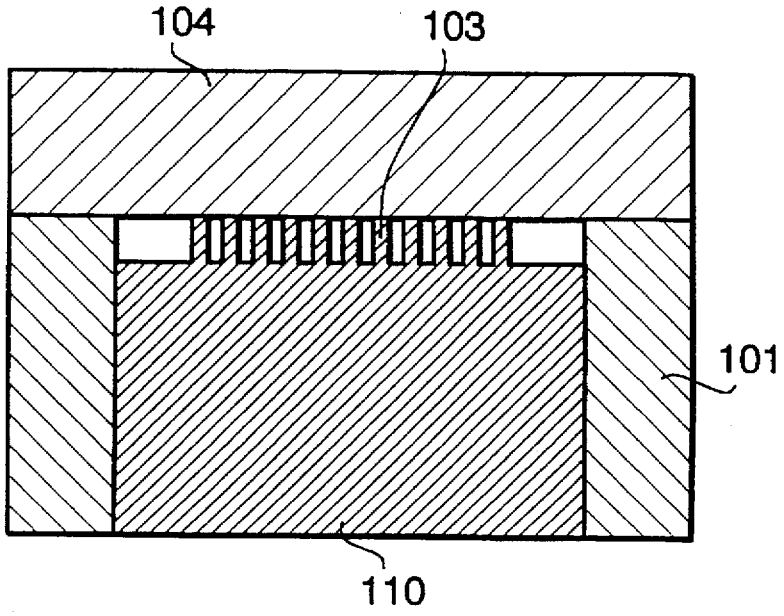
FIG. 4 is a sectional schematic view of a mold used in a method for manufacturing an ink jet nozzle array plate, taken along the section line IV—IV of FIG. 3.

In this embodiment, the nozzle plate 1 is injection molded from polyethersulfone (PES) resin. FIGS. 3 and 4 are schematic side views of a metal mold for forming a nozzle plate of the desired shape. FIG. 4 is a section taken along line IV—IV of FIG. 3.

In FIGS. 3 and 4, raised portions 103 correspond to the nozzles 2. The shape of the linear array of raised portions 103 is unitarily formed from a core 110 (in this embodiment, by wire cutting), and each portion 103 is cut by a dicing treatment. During injection molding, the molding material is led from a gate 100 and fills the space formed by a stationary mold plate 104, a movable mold plate 101, and the core 110 (having the raised portions 103). The temperature of the metal mold at this time is approximately 150° C., the temperature of the PES resin is approximately 370° C., and the pressure at which the resin is applied is approximately 1200 to 1500 kg/cm$^2$.

Thereafter, the stationary mold plate 104 and the movable moving plate 101 are opened, and an eject pin 102 moves in a direction indicated by the arrow E in FIG. 3 to remove the nozzle plate 1 from the movable mold plate 101. Thus, a nozzle plate 1 having nozzles 2 arranged therein in the predetermined pattern is formed.

As alternatives (to PES resin) for an injection molded nozzle plate 1, liquid crystal polymer, polyacetal, poly (phenylsulfone), polyphthalamide, polyphenylene oxide, polyetherimide, polysulfone, polycarbonate, and other resin materials can be used.

Furthermore, the nozzle plate 1 can alternatively be formed by injection molding using ceramic powders or metallic powders in a binder. That is, the ceramic or metallic powder is mixed in a binder, for example a resin, and injection molded in a metal mold. Subsequently, the resin-powder molded member is taken from the mold, and a degreasing treatment is applied, to obtain a degreased member. Thereafter, the degreased member is sintered, finally giving a sintered nozzle plate 1. In the sintering process, the degreased member contracts by about 10% to 30% from the metal mold dimensions. Accordingly, when a sintering process is used, the metal mold is made larger than the final product by taking the contraction amount into consideration. Ceramic and metallic powders such as alumina, zirconia, silicon nitride, silicon carbonate, and stainless steel can be used.

When forming a nozzle plate 1 by any of the above-described methods, materials, dust, burrs, flash, and films are formed inside the nozzle 2 depending on the characteristics of the method.

According to this embodiment, in injection molding of the nozzle plate 1, flash and burrs normally form at the exit sides of the nozzles 2 because of the gap between the stationary mold plate 104 and the respective raised portions 103. The extent of the formation of flash and burrs depends on the molding material, mold temperature, material temperature, and filling pressure.

Injection molding is suitable for mass production, and the shape of the nozzles 2 are freely designed. For example, a relatively large taper angle in the nozzles 2 can be achieved.

Figure 5:
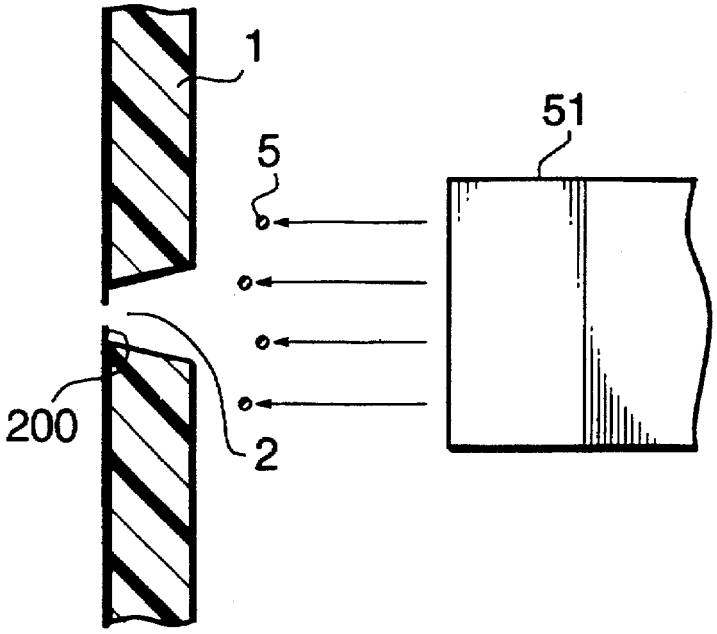
FIG. 5 is a side schematic view of a first embodiment of a method for manufacturing an ink jet nozzle according to the invention.

In this embodiment, fine particle abrasive blasting is used to remove the flash and burrs. As illustrated in FIG. 5, fine particles 5 are blown from a blasting head 51 onto the portion of the nozzle plate 1 in which the nozzles 2 are formed. The fine particles 5, expelled from the blasting head 51 at a high velocity, strike the flash 200 formed at the exits of the nozzles 2 and remove the flash 200 by abrasive blasting. Usually, the flash 200 is very thin but closes the exits of the nozzles 2. Therefore, the fine particles 5 primarily strike the flash 200, and the flash 200 can be effectively and reliably removed. Alumina, steel pellets or chips, sand, glass, hardened resin and other abrasive agents can be used as fine particles 5. It is a matter of course to choose the abrasive type appropriate for the material of the nozzle plate 1, and in this case, for the PES resin of the injection molded nozzle plate 1, alumina particles are used. Fine alumina particles of controlled diameter are easily obtained, and alumina is hard enough to grind PES resin. Accordingly, it has high processing precision, and is easily treated. The diameter of the fine particles 5 is chosen in accordance with the material and nozzle size of the nozzle plate 1. Preferably, all of the nozzles 2 of a nozzle plate 1 are processed simultaneously.

In this method, a nozzle array member (the nozzle plate 1) having a plurality of nozzle holes is made by a variety of procedures in accordance with the predetermined pattern, and thereafter, the fine particles 5 are blasted at least at the nozzle portions 2. Flash 200, burrs and dust on the inner surfaces of the nozzles 2 and in the vicinity of the nozzle portions are abrasive blasted and a high precision nozzle 2 having improved ink discharge characteristics is formed.

For nozzles 2 having an exit diameter from 10 μm to 150 μm, particles having a diameter from 1 μm to 100 μm are appropriate. If the fine particle 5 size is less than 1 μm, the force applied to the flash 200 is small, and removal of the flash 200 is insufficient and too slow. If the diameter is greater than 100 μm, the particles 5 may jam the nozzles 2 or enlarge the nozzle 2 exits. In this embodiment, the nozzle diameter is 40 μm, and alumina particles of 10 μm are used to remove the flash 200. Additionally, for the blasting apparatus, it is preferable that the abrasive blasting is carried out at a speed of less than 100 m/s, and a pressure of less than 5 bar. If the energy of the fine particles 5 becomes too high, the inner surfaces of the nozzles 2 or nozzle plate 1 may be damaged.

Accordingly, excessive abrading or damage by the fine abrasive particles 5 is prevented with these operating parameters, and distortion or displacement of the nozzle 2 dimensions does not occur.

As previously described, if the meniscus formed in each nozzle 2 becomes withdrawn, the amount of ink expelled varies, and a stable ink discharge cannot be performed. To keep the ink discharge of the ink jet head uniform, in this embodiment, the inner walls of the nozzle 2 and the vicinity of the nozzles 2 are slightly abraded by the fine particles to improve the ink affinity characteristic thereof, preventing the retraction of the meniscus. This surface roughening is not enough to disturb the flow of ink in the nozzle 2, but rather forms a fine unevenness on the surface therein.

In this manner, ink flow characteristics in the vicinity of the nozzles 2 is improved by surface roughening, preventing the withdrawal of the meniscus, and nozzles 2 capable of forming stable ink jets can be made.

Figure 6:
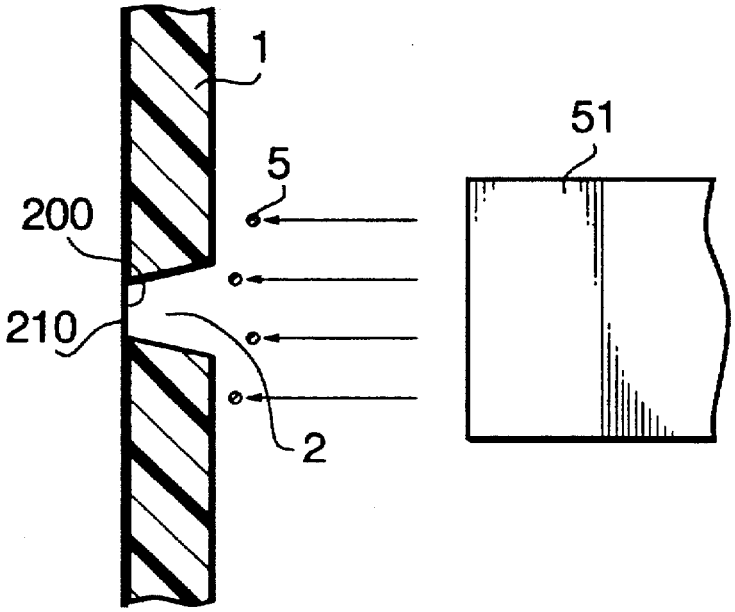
FIG. 6 is a side schematic view of a second embodiment of a method for manufacturing an ink jet nozzle according to the invention.

In a second embodiment of a manufacturing method for ink jet nozzles, as illustrated in FIG. 6, abrasive blasting is performed on a thin solid flash portion 210 formed on the nozzle exit side of the nozzle plate 1 at the time of molding, all of the nozzles 2 having substantially the same thickness of thin solid flash portion. In the absence of such a thin solid portion 210, the condition of the flash 200 generated on each nozzle 2 during injection molding differs from nozzle to nozzle. That is, some nozzles may be mostly closed by the flash 200, and some may have hardly any flash. If the same abrasive blasting is done for nozzles having varying conditions of flash 200, the shapes of the nozzle exits may minutely vary. However, if the same thin solid flash portion 210 is intentionally formed on the exit side of all of the nozzles 2, the same shape is obtained for each of the nozzles 2 when the abrasive blasting treatment is applied.

In the second embodiment, the plurality of nozzle depressions are formed in the nozzle array plate 1, the depressions arranged at predetermined pitches and having a predetermined depth. That is, the nozzle depressions correspond to the nozzles 2, and go nearly all the way through the nozzle array plate 1, thus forming a predetermined thin solid flash portion 210 at an exit end of each of the nozzle depressions. Abrasive blasting is carried out to blasting through each of the thin solid flash portions 210; and by consistently blasting through the thin solid flash portions 210, nozzle holes of a predetermined size are formed in said nozzle array member 1.

In this manner, the shapes of the respective nozzle hole portions is uniform. By carrying out uniform abrasive blasting, nozzle holes having uniform internal conditions can thereby be made, giving nozzles 2 capable of high quality printing and consistent ink jet characteristics.

According to the manufacturing method of the described embodiments, a nozzle plate body 10 having a plurality of nozzles 2 is formed by injection molding. Thereafter, abrasive blasting is done at least to the inner walls of the nozzles 2 and the vicinity thereof of the nozzle platel, to remove flash 200 and burrs at the exit side of the nozzles 2. Accordingly, since all of the nozzles 2 of a nozzle plate are processed quickly and simultaneously, manufacturing efficiency is suitable for mass production. Furthermore, the abrasive blasting is applied from the entry side of the nozzles to form a fine unevenness on the inner surfaces of the nozzles 2 and improving the ink affinity characteristics of the nozzles 2.

What is claimed is:

1. A method for manufacturing a nozzle for an ink jet printer, said nozzle having an ink chamber attached to an entry side and discharging ink from an exit side of said nozzle which is a side opposite to said entry side, said method comprising the steps of:

forming a plurality of nozzle depressions in a nozzle array member according to a predetermined pattern; and forming said nozzle from said nozzle depressions by abrasive blasting at least said nozzle depressions formed in said nozzle array member.

2. The method according to claim 1, wherein said abrasive blasting comprises a step of:

removing flash and burrs from the inner surfaces of said nozzle depressions formed in said nozzle array member.

3. The method according to claim 1, wherein said abrasive blasting is applied on the entry side of said nozzle array member, and wherein said abrasive blasting comprises a step of:

surface roughening at least the inner surfaces and the vicinity thereof of said nozzle depressions formed in said nozzle array member.

4. The method according to claim 1, wherein said abrasive blasting comprises a step of:

blasting fine abrasive from 1 μm to 100 μm particle diameter to nozzle depressions having 10 μm to 150 μm depression diameter formed in said nozzle array member.

5. The method according to claim 1, wherein said abrasive blasting comprises a step of:

blasting fine abrasive at said nozzle array member at a speed of less than 100 m/s, and at a pressure of less than 5 bar.

6. The method according to claim 1, wherein said abrasive blasting comprises a step of:

blasting alumina abrasive particles at said nozzle depressions formed in said nozzle array member.

7. The method according to claim 1, further comprising the step of:

injection molding a nozzle array member having a plurality of nozzle depressions according to a predetermined pattern.

8. The method according to claim 7, wherein said nozzle array member is injection molded from polyethersulfone (PES) resin.

9. The method according to claim 7, wherein said nozzle array member is injection molded from the group of resins consisting of: liquid crystal polymer, polyacetal, poly(phenylsulfone), polyphthalamide, polyphenylene oxide, polyetherimide, polysulfone, and polycarbonate.

10. The method in accordance with claim 1 comprising the further steps of forming a thin solid flash portion of a predetermined thickness at an exit end of each of said nozzle depressions;

abrasive blasting through each of said thin solid flash portions; and forming nozzle holes of a predetermined size in said nozzle depressions of said nozzle array member.

11. The method according to claim 10, wherein said abrasive blasting comprises a step of:

removing flash and burrs from the inner surfaces of said nozzle holes formed in said nozzle array member.

12. The method according to claim 10, wherein said abrasive blasting is applied on the entry side of said nozzle array member, and wherein said abrasive blasting comprises a step of:

surface roughening at least the inner surfaces and the vicinity thereof of said nozzle holes formed in said nozzle array member.

13. The method according to claim 10, wherein said abrasive blasting comprises a step of:

blasting fine abrasive from 1 μm to 100 μm particle diameter to nozzle holes having 10 μm to 150 μm hole diameter formed in said nozzle array member.

14. The method according to claim 10, wherein said abrasive blasting comprises a step of:

blasting fine abrasive at said nozzle array member at a speed of less than 100 m/s, and at a pressure of less than 5 bar.

15. The method according to claim 10, wherein said abrasive blasting comprises a step of:

blasting alumina abrasive particles at said nozzle holes formed in said nozzle array member.

16. The method according to claim 10, further comprising the step of:

injection molding a nozzle array member having a plurality of nozzle depressions according to a predetermined pattern.

17. The method according to claim 16, wherein said nozzle array member is injection molded from polyethersulfone (PES) resin.

18. The method according to claim 16, wherein said nozzle array member is injection molded from the group of resins consisting of: liquid crystal polymer, polyacetal, poly(phenylsulfone), polyphthalamide, polyphenylene oxide, polyetherimide, polysulfone, and polycarbonate.

19. The method according to claim 1, wherein nozzle holes penetrating the nozzle array member are formed by the abrasive blasting step.

* * * * *